US005400296A

United States Patent [19]

Cushman et al.

[11] Patent Number: 5,400,296

[45] Date of Patent: Mar. 21, 1995

[54] ACOUSTIC ATTENUATION AND VIBRATION DAMPING MATERIALS

[75] Inventors: William B. Cushman; Gerald B. Thomas, both of Pensacola, Fla.

[73] Assignees: Poiesis Research, Inc., Pensacola, Fla.; The United States of America as represented by the Secretary of the Navy, Washington, D.C.

[21] Appl. No.: 186,058

[22] Filed: Jan. 25, 1994

[51] Int. Cl.[6] ..... G10K 11/16

[52] U.S. Cl. ..... 367/1; 181/284

[58] Field of Search ..... 367/1; 252/62; 181/207, 181/284, 286, 290, 294, 296

[56] References Cited

U.S. PATENT DOCUMENTS

| | | | |
|---|---|---|---|
| 2,198,885 | 4/1940 | Price | 181/290 |
| 3,615,961 | 10/1971 | Meyer et al. | 181/296 |
| 3,894,169 | 7/1975 | Miller | 367/1 |

OTHER PUBLICATIONS

Cramer, Sound-Absorbing Linings For Waterfilled Tanks, Jul. 1963, pp. 18-24.

"Material Damping and Slip Damping" by L. E. Goodman in *Shock and Vibration Handbook* (3rd. Ed) C. M. Harris, ed. 1991.

"Sound Absorptive Materials" by Ron Moulder, in *Handbook of Acoustical Measurements and Noise Control* C. M. Harris, ed 1988.

*Primary Examiner*—Daniel T. Pihulic

[57] ABSTRACT

A means of enhancing the acoustic attenuation and vibration damping of a material by embedding high characteristic acoustic impedance particles, low characteristic acoustic impedance particles, or both high and low characteristic acoustic impedance particles within the matrix of the material is disclosed. The mass of the resultant material may be very low while retaining excellent acoustic attenuation, vibration damping, and structural characteristics. When particles with mismatched characteristic acoustic impedances are embedded within the matrix of a material that can support shearing loads, propagating acoustic energy that encounters the particles of the instant invention is partially reflected in random directions. That is, the propagating energy is diffused. As the propagation vectors and modes of acoustic energy are effectively randomized, the probability of localized energy absorption and damping is increased. We present acoustic attenuation and vibration damping data for some representative examples of the instant invention and other commercially available materials.

11 Claims, 5 Drawing Sheets

-5
-10
-15
-20
-25
-30
dB of Attenuation
21
22
23
24
0%
2.5%
5%
7.5%
10%
Percent Glass -5
-10
-15
-20
-25
-30
dB of Attenuation
25
26
27
28
0%
25%
50%
75%
Percent Lead 0
-10
-20
-30
-40
-50
dB of Attenuation
16
29
30
18
33.6
61.0
125.1
253.3
1269.5
Frequency -24
-28
-32
-36
dB of Attenuation
31
32
33
34
0%
5%
10%
Percent Glass -28
-32
-36
-40
dB of Attenuation
35
36
37
38
0%
25%
50%
75%
Percent Lead -25
-30
-35
-40
-45
-50
dB of Attenuation
19
39
40
20
33.6
61.0
125.1
253.3
1269.5
Frequency

ACOUSTIC ATTENUATION AND VIBRATION DAMPING MATERIALS

BACKGROUND OF THE INVENTION

1. Field of the Invention

This invention relates to acoustic attenuation and vibration damping materials, particularly to acoustic attenuation and vibration damping materials intended to be placed between acoustic and/or vibratory energy sources and acoustic and/or vibration protected areas.

2. Description of Related Art

Numerous methods currently exist for the control of acoustic noise and vibration ranging from simple, passive barrier and damping techniques to more sophisticated electronic noise canceling approaches. These methods may target either the noise or vibration source, the transmission path, the receiving site, or any or all of the preceding in combination. The instant invention is of the barrier class and utilizes a composite material composed of a matrix material containing filler particles with high and/or low characteristic acoustic impedances to provide improved sound attenuation, vibration damping, and weight characteristics. By careful selection of matrix material and filler particles, the design engineer can create a composite material with an optimal balance of sound and vibration attenuation, weight, strength, temperature characteristics, and durometer.

Within the field of noise control, absorptive techniques are typically utilized to prevent or reduce air-borne acoustic energy from reaching a receiving site. Similarly, vibration damping techniques are usually applied in close contact with the vibrating structure to prevent or reduce air-borne or structure-borne energy from propagating to the protected area. Both techniques utilize internal damping of impinging acoustic energy as an important means of reducing energy levels and therefore share basic principles. A general review of the art in this area is available from "Material Damping and Slip Damping" by L. E. Goodman (*Shock & Vibration Handbook* (3rd ed.), Cyril M. Harris (ed.), 1987) and from "Sound-Absorptive Materials" by Ron Moulder (*Handbook of Acoustical Measurements and Noise Control* (3rd ed.), Cyril M. Harris (ed.), 1991), but a brief overview follows.

Currently available materials capable of absorbing unwanted acoustic energy (i.e., noise) are most effective at frequencies above 500 Hz. Noise attenuation rapidly worsens as lower frequencies are encountered with the result being that few material manufacturers even report attenuation values below 125 Hz.

Most sound absorptive materials, such as foams, felts, etc., are highly porous in structure with the pores intercommunicating throughout the material. The pores may be formed by interconnected solid bubbles, or interstices between small granules, or they may be inherent in naturally porous fibrous materials such as fiberglass. The amplitude of sound waves entering the porous material is reduced through friction between the air molecules and the surfaces of the pores. These materials tend to be light in weight and most effective at shorter wavelengths (i.e., higher frequencies). Unless these porous materials form part of a layered, or constrained, composite with a denser, less porous material, their structural strength is limited.

In order to attenuate lower frequencies, absorptive materials are usually combined with a rigid material with an air space separating the two materials. The amount of low frequency attenuation is directly related to the size of this air space. This approach of combining a sound absorptive material with a rigid material and a separating air space increases both the overall weight and thickness of the resulting sound attenuating structure and therefore may not be feasible in a given application. A significant problem with this approach is the fact that many structures must be load bearing as well as sound absorbing, necessitating the inclusion of solid members between rigid materials. These solid members often provide a very good conduit for acoustic energy, thereby partially defeating the structures' sound attenuating properties.

Another approach embodies the "mass law" which applies to a relatively thin, homogeneous, single layer panel. The mass law states that the loss of energy as it transits a barrier is, over a wide frequency range, a function of the surface density of the barrier material and the frequency in question. In general, this transmission loss increases by 6 dB for each octave increase in frequency and for each doubling of the mass of the material. Thus, increasing the mass of the material through increases in thickness or density can improve the acoustic barrier for all frequencies including those in the lower portion of the spectrum. This gain in transmission loss is at the cost of added barrier weight.

Materials utilized specifically for vibration damping follow many of the same rules as those in the absorptive class but are, as a general rule, optimized for attenuating the lower frequencies. As a result, many of these materials are of higher densities and thicknesses and tend to depend more on the internal damping of energy penetrating the material than upon the "capture" of acoustic energy by way of a porous architecture.

SUMMARY OF THE INVENTION

Accordingly, an object of the instant invention is to provide an improved method for enhancing the bulk acoustic attenuation and vibration damping of materials.

Another object of the instant invention is to provide an improved acoustic attenuation and vibration damping material with superior structural capability.

A further object of the instant invention is to provide an improved acoustic attenuation and vibration damping material that is light in weight.

These and additional objects of the invention are accomplished by embedding a plurality of small particles of either a high characteristic acoustic impedance or a low characteristic acoustic impedance or combinations of high and low characteristic acoustic impedance materials within the matrix material being used as a bulk acoustic attenuator or vibration damper.

BRIEF DESCRIPTION OF THE DRAWINGS

In the following Description of the Preferred Embodiments and the accompanying drawings, like numerals in different figures represent the same structures or elements. The representation in each of the figures is diagrammatic and no attempt is made to indicate actual scales or precise ratios. Proportional relationships are shown as approximations.

DESCRIPTION OF THE PREFERRED EMBODIMENTS

Figure 1:
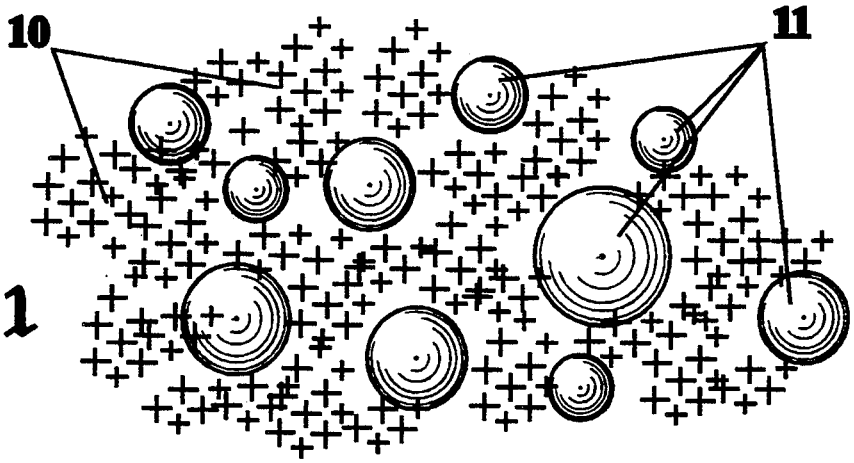
FIG. 1 shows a matrix material of the instant invention with a plurality of embedded low characteristic acoustic impedance particles.

The parts indicated on the drawings by numerals are identified below to aid in the reader's understanding of the present invention.

10. Matrix material.
11. Low characteristic acoustic impedance particles.
12. High characteristic acoustic impedance particles.
13. Commercial acoustic absorption material.
14. Commercial acoustic absorption material.
15. Dow Corning ® Silastic ® K RTV silicone rubber.
16. Dow Corning ® Silastic ® T RTV silicone rubber.
17. Devcon ® Flexane ® 80 Liquid urethane.
18. Silastic ® T RTV silicone rubber with 4.0% by weight embedded glass micro spheres with diameters ranging from roughly 10 to roughly 100 microns and 48.0% embedded 99% pure lead particles with diameters ranging from roughly 5 to roughly 100 microns.
19. Devcon ® Flexane ® 94 Liquid urethane.
20. Devcon ® Flexane ® 94 Liquid urethane with 3.3% embedded glass micro spheres with diameters ranging from roughly 10 to roughly 100 microns and 33.8% embedded 99% pure lead particles with diameters ranging from roughly 5 to roughly 100 microns.
21. Attenuation curve for 253.3 Hz.
22. Attenuation curve for 125.1 Hz.
23. Attenuation curve for 33.3 Hz.
24. Attenuation curve for 61.0 Hz.
25. Attenuation curve for 253.3 Hz.
26. Attenuation curve for 125.1 Hz.
27. Attenuation curve for 33.3 Hz.
28. Attenuation curve for 61.0 Hz.
29. Dow Corning ® Silastic ® T RTV silicone rubber with 50% by weight embedded 99% pure lead with diameters ranging from roughly 5 to roughly 100 microns.
30. Dow Corning ® Silastic ® T RTV silicone rubber with 7.5% by weight embedded glass micro spheres with diameters ranging from roughly 10 to roughly 100 microns.
31. Attenuation curve for 33.6 Hz.
32. Attenuation curve for 61.0 Hz.
33. Attenuation curve for 125.1 Hz.
34. Attenuation curve for 253.3 Hz.
35. Attenuation curve for 33.6 Hz.
36. Attenuation curve for 61.0 Hz.
37. Attenuation curve for 125.1 Hz.
38. Attenuation curve for 253.3 Hz.
39. Devcon ® Flexane ® 94 Liquid urethane with 5% by weight embedded glass micro spheres with diameters ranging from roughly 10 to roughly 100 microns.
40. Devcon ® Flexane ® 94 Liquid urethane with 50% by weight embedded 99% pure lead particles with diameters ranging from roughly 5 to roughly 100 microns.

The instant invention comprises a means of modifying the internal acoustic and vibration transmission characteristics of a material by placing within that material a plurality of particles of low characteristic acoustic impedance material, of high characteristic acoustic impedance material, or a combination of low and high characteristic acoustic impedance materials. The terms "high characteristic acoustic impedance" and "low characteristic acoustic impedance" refer to characteristic acoustic impedances relative to the characteristic acoustic impedance of the substrate or "matrix" material.

The authors posit that there are three physical phenomena that can account for nearly all acoustic or vibratory attenuation when sound or vibration travels from one area to another through any medium or combination of media. These physical processes are described below for the convenience of the reader.

Acoustic Impedance Mismatches

Characteristic acoustic impedance mismatches always cause some portion of the impinging acoustic or vibratory energy to be reflected, thus attenuating that portion transmitted past the mismatched boundary. There are three general cases for acoustic energy transmission across a boundary: 1) the characteristic acoustic impedance of the first material is lower than the second material; 2) the two impedances match; 3) the characteristic acoustic impedance of the first material is higher than the second material.

An example of the first case would be an acoustic pressure wave propagating in air that encounters a steel wall. If the steel is infinitely "hard" (infinitely high characteristic acoustic impedance), then the particle velocity produced by the acoustic pressure wave in the air immediately adjacent to the steel wall is zero, and pressure waves impacting the wall will be rebounded intact and in phase. Pressure doubling can occur in this situation. A softer wall "gives way" under the influence of incoming pressure waves (the characteristic acoustic impedance is lower) and a smaller proportion of the incoming acoustic energy is reflected; the remainder is transmitted past the boundary into the medium of the wall.

In the second case, where the characteristic acoustic impedance of the initial medium and the wall is matched, there is no reflected energy and the acoustic signal continues to propagate in its initial direction.

An example of the third case is an acoustic pressure wave traveling in a large block of steel to a boundary with vacuum (a very low characteristic acoustic impedance). In this case the particle velocity at the wall is precipitously unrestricted by the boundary and increases within the limits of the strength of the material, thus giving rise to a rarefaction wave traveling in the reflected direction. A rarefaction wave is a phase inverted pressure wave. In the case where reflected but phase inverted acoustic energy directly mixes with incoming energy, cancellation can take place.

Friction

In all cases where acoustic or vibratory energy is propagated within or between media there is actual displacement of the boundary and the molecules within the media. Physical displacement generally produces friction, and the energy loss due to friction is subtracted from the propagating acoustic energy. When a material has a high characteristic internal friction it has a high "damping factor" because more energy is converted into heat.

Energy Propagation Modality Changes

Gasses and liquids cannot support shear loads and always propagate acoustic energy in a simple mode with the wave-front perpendicular to the direction of travel. On the other hand, solids can propagate acoustic energy in various modalities including as torsion waves, transverse waves, compression waves and simultaneous combinations of all these. This property makes predicting the behavior of a particular acoustic wave in a solid difficult. However, if a propagating acoustic or vibratory pressure wave traveling in a direct line through some medium can be locally redirected within that medium, even slightly, then the probability that that propagating acoustic energy remains in phase with and mutually supportive of propagating acoustic energy at adjacent locations is diminished.

From an acoustic point of view, liquids and gasses behave differently than solids. If the medium through which an acoustic pressure wave is traveling is a liquid or gas, an encounter with a localized impedance mismatch such as a particle of a different material will cause a localized reflection. The medium cannot support shear loads so none of the reflected energy can be redirected into other modes of travel. Some attenuation will occur. On the other hand, if the transmitting medium is a solid and a particle with a different characteristic acoustic impedance is encountered, then an opportunity arises for the mode of propagation to be transformed into another form. Changing the mode of propagation from, for example, a simple mode into a transverse wave increases the probability of dissipating energy with friction or phase cancellation. The transverse wave thus created is quite unlikely to be in phase with similar energy from adjacent locations. This point of view suggests the somewhat counterintuitive notions: (1) the more "liquid-like" a material is the poorer its attenuation is likely to be if the attenuation mode being exploited is based upon localized impedance mismatches and (2) the weight of the particles being used has little relevance for the effectiveness of attenuation achieved; the predominant factor is the relative degree of impedance mismatch. It is not usually appreciated, for example, that both brass and steel have higher characteristic impedances than lead, and may be better choices in some applications. In all cases the internal damping characteristic of the material used is of paramount importance, as it is ultimately friction that always accounts for acoustic energy dissipation.

FIG. 1 shows a matrix material, 10, of the instant invention with embedded low characteristic acoustic impedance particles, 11. A preferred low characteristic acoustic impedance particle is a hollow glass micro sphere.

Figure 2:
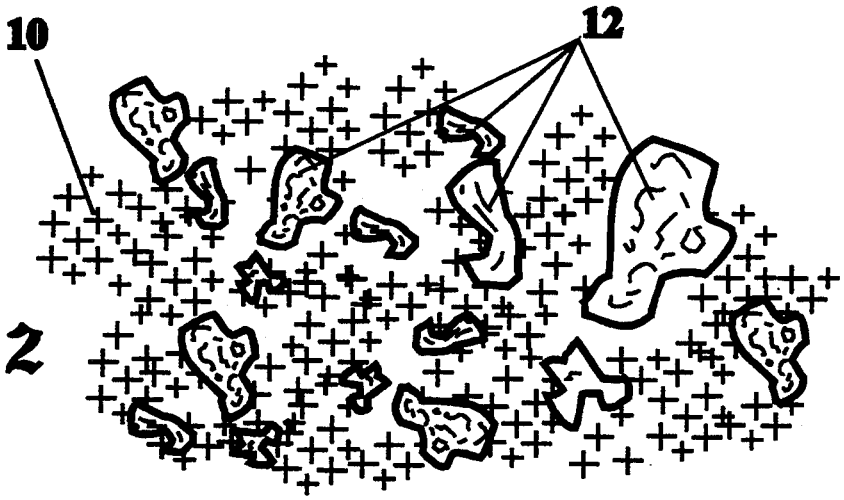
FIG. 2 shows a matrix material of the instant invention with a plurality of embedded high characteristic acoustic impedance particles.

FIG. 2 shows a matrix material, 10, of the instant invention with embedded high characteristic acoustic impedance particles, 12. A preferred high characteristic acoustic impedance particle is a metal.

Figure 3:
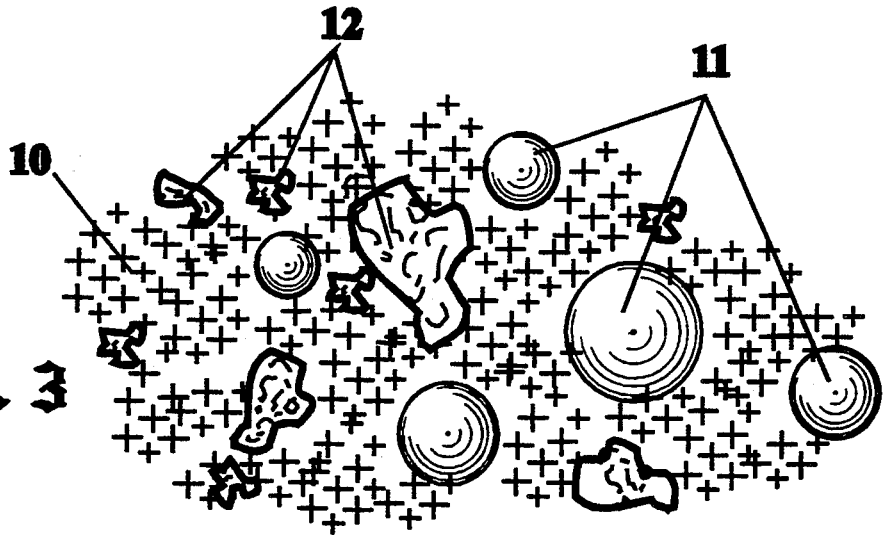
FIG. 3 shows a matrix material of the instant invention with a plurality of embedded low characteristic acoustic impedance particles and a plurality of embedded high characteristic acoustic impedance particles.

FIG. 3 shows a matrix material, 10, of the instant invention with embedded low characteristic acoustic impedance particles, 11, and embedded high characteristic acoustic impedance particles, 12.

FIGS. 4 through 10 present attenuation data gathered in accordance with the following method. The materials to be tested were formed or cast into rings of identical dimensions (except where noted) and then positioned so as to surround a sensing microphone mounted in a high mass flat plate coupler. Direct air-borne sound was prevented from reaching the microphone by a high mass, stainless steel cover which also served to clamp the test ring in position. Attenuation measurements were taken in a semireverberant sound chamber using a pink noise source to produce a uniform sound pressure field of 120 dB (SPL). Samples were digitized and submitted to a Fast Fourier Transform procedure for analysis. Samples were 12 bit resolution, 8192 words in length and were collected at 50 kHz. Fifty samples were taken consecutively for each material tested and for an open microphone reference condition. After data collection and Fourier analysis all fifty samples were averaged binwise. Data from material samples were then subtracted from the reference data to obtain attenuation data. These results were verified using the alternative procedure of simply placing test materials over the aperture of the sensing microphone and collecting data samples.

Figure 4:
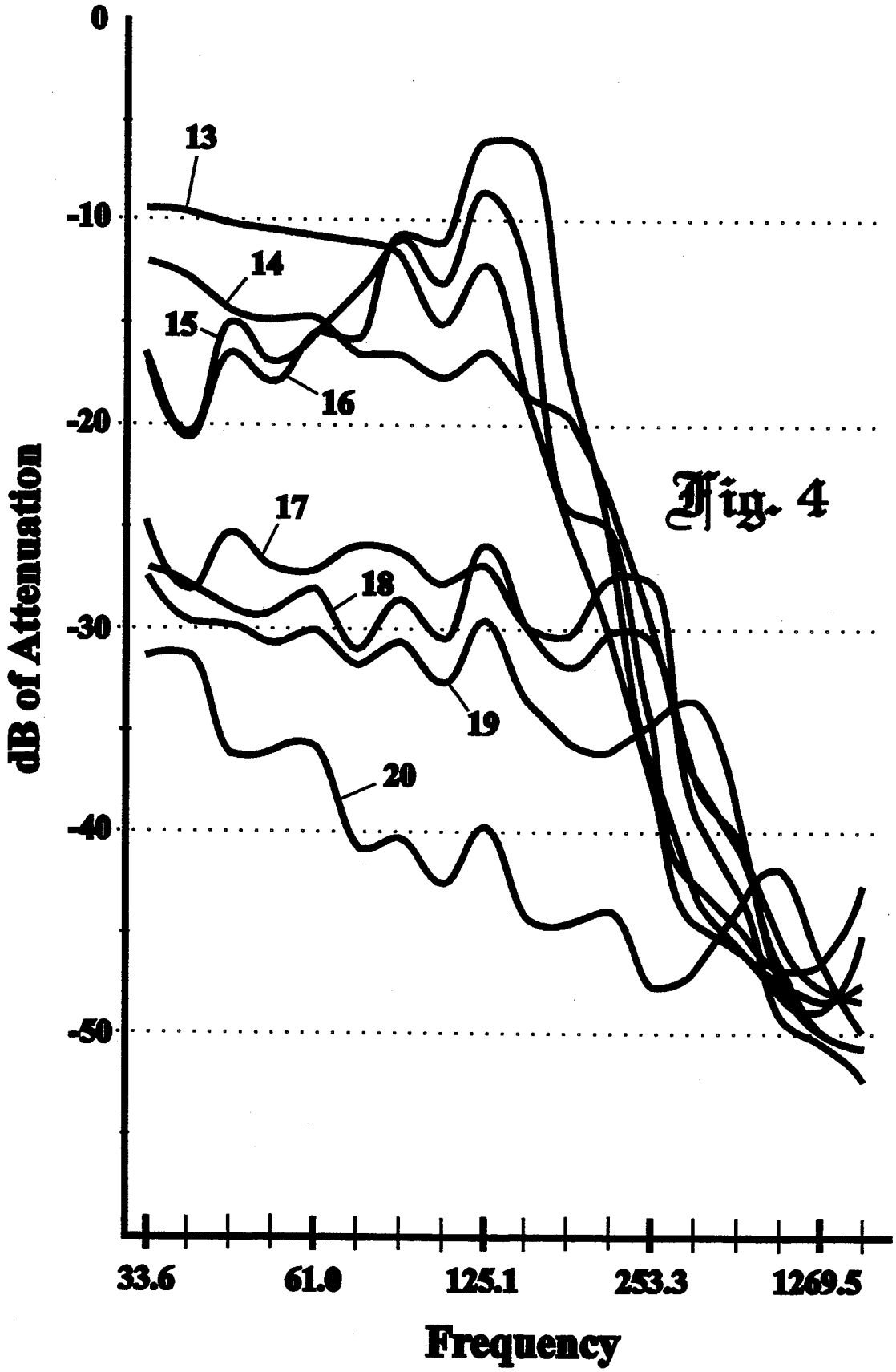
FIG. 4 is a graph showing the acoustic attenuation characteristic at a range of frequencies of two exemplary embodiments of the instant invention and the acoustic attenuation characteristic at a range of frequencies of several commercially available materials under the same conditions.

FIG. 4 shows the experimentally derived attenuation over a range of frequencies for several common materials and two exemplary embodiments of the instant invention. Material 13 is a widely used commercial acoustic absorbing material with a durometer of 30A, a density of approximately 1.31 g/ml, and a test sample thickness of 5.84 mm. A second commercial acoustic absorbing material, 14, has a durometer of 50A, a density of approximately 1.34 g/ml, and a test sample thickness of 3.43 mm. All other test materials used for the data shown in FIGS. 4 through 10 have a thickness of 4.70 mm. Other commercially available materials shown in FIG. 4 are: Dow Corning ® Silastic ® K RTV silicone rubber, 15 (durometer 50A; density 1.26 g/ml); Dow Coming ® Silastic ® T RTV silicone rubber, 16 (durometer 35A; density, 1.08 g/ml); Devcon ® Flexane ® 80 Liquid urethane, 17, (durometer 87A; density, 1.09 g/ml); and Devcon ® Flexane ® 94 Liquid urethane, 19 (durometer, 97A; density, 1.07 g/ml). Exemplary embodiments of the instant invention shown in FIG. 4 are: Silastic ® T RTV silicone rubber with 4.0% by weight embedded glass micro spheres with diameters ranging from roughly 10 to roughly 100 microns and with 48.0% by weight embedded 99% pure lead particles with diameters ranging in size from roughly 5 to roughly 100 microns, 18, (density, 1.46 g/ml); and Devcon ® Flexane ® 94 Liquid urethane with 3.3% by weight embedded micro spheres with diameters ranging from roughly 10 to roughly 100 microns and with 33.8% by weight embedded 99% pure lead particles with diameters ranging from roughly 5 to roughly 100 microns, 20 (density, 1.28 g/ml).

FIG. 4, as is the case with succeeding figures, graphically displays attenuation data only for frequencies below 2000 Hz. This is because these frequencies have traditionally been the most difficult to attenuate and because differences in attenuation among materials are minimal above 2000 Hz.

The two commercial sound absorbing materials, 13, and 14, show very poor attenuation below 250 Hz but rapidly improve as 1000 Hz is approached. Their durometers are similar to the two RTV silicone rubbers shown, 15, and 16, but the silicone rubbers perform better at the very lowest frequencies. Materials with significantly greater durometers, the urethanes, 17 and 19, represent a significant improvement in sound attenuating abilities. This would be predicted given traditional teachings relating sound attenuation with material "hardness." What is of particular interest in FIG. 4 is the attenuation performances of the two embodiments, 18 and 20, of the instant invention.

Material 18 is a composite created according to the teachings of the instant invention and provides an additional 10–15 dB of attenuation over that of the matrix material alone. This represents a better than 150% improvement in acoustic energy attenuation and places this material in a class with much higher durometer materials while still retaining many desirable low durometer characteristics.

Material 20 is a composite created according to the teachings of the instant invention and provides an additional 2–10 dB of attenuation over that of the matrix material alone. This represents a 30%–150% improvement in acoustic energy attenuation. Tests of composites with high lead concentrations (up to 75%, not shown) did not attenuate acoustic energy as well as Material 20 and weighed up to 300% more.

Two Design Examples: A RTV Silicone Rubber and a Urethane Substrate

Particular implementations of the instant invention can be devised using the following procedure. In most cases a designer will begin with a consideration of the structural qualities of his desired product and work backwards from there. The structural requirements of a particular job may limit the choices to a particular class of materials. For example, a material may be required to withstand a moderately high heat, making the silicone rubbers desirable choices. Or the requirement may be for a light but effective material, making lead an undesirable ingredient. The instant invention disclosed herein allows the designer to begin a particular design by picking the matrix material of choice first and then enhancing that material to improve its acoustic properties with the addition of embedded high and/or low characteristic impedance particles.

To optimize the acoustic absorption and vibration damping of any given solid or elastomeric material, the designer should first pick the high and/or low characteristic acoustic impedance particles and the matrix material to be used. Generally, an extreme difference in characteristic acoustic impedance between high and low characteristic acoustic impedance particles and matrix material is preferred. The designer should then make several samples of the matrix material with different proportions of each particle type separately. He should test these samples using the same frequency ranges to which the end product will be subjected. He should then graph the results with separate graphs for samples containing each particle type. These graphs will show attenuation as a function of particle concentration at a selection of frequencies. The designer should then pick a concentration where the attenuation is best or has just begun to flatten out for each particle used, if possible, and use this concentration as the basis for calculating the concentration of mixed high and low characteristic acoustic impedance particles in the final matrix if more than one particle type is required. It may be found that the particles tested have little positive effect relative to deleterious properties. Lead particles in silicone rubber seem to be in this category, the increase in attenuation they provide may not be worth the increased weight.

The attenuating effect of embedding high characteristic acoustic impedance particles in a matrix material seems to be different than embedding low characteristic acoustic impedance particles in a matrix material. The acoustic attenuation from a combination of both high and low characteristic impedance particles is often much better than any practicable concentration of each individually. In the case of both Devcon ® Flexane ® 94 Liquid urethane and Silastic ® T RTV used in our experiments the attenuating effect of glass micro spheres and lead particles is more than simply additive, a synergistic effect appears to be present.

RTV Silicone Rubber

Figure 5:
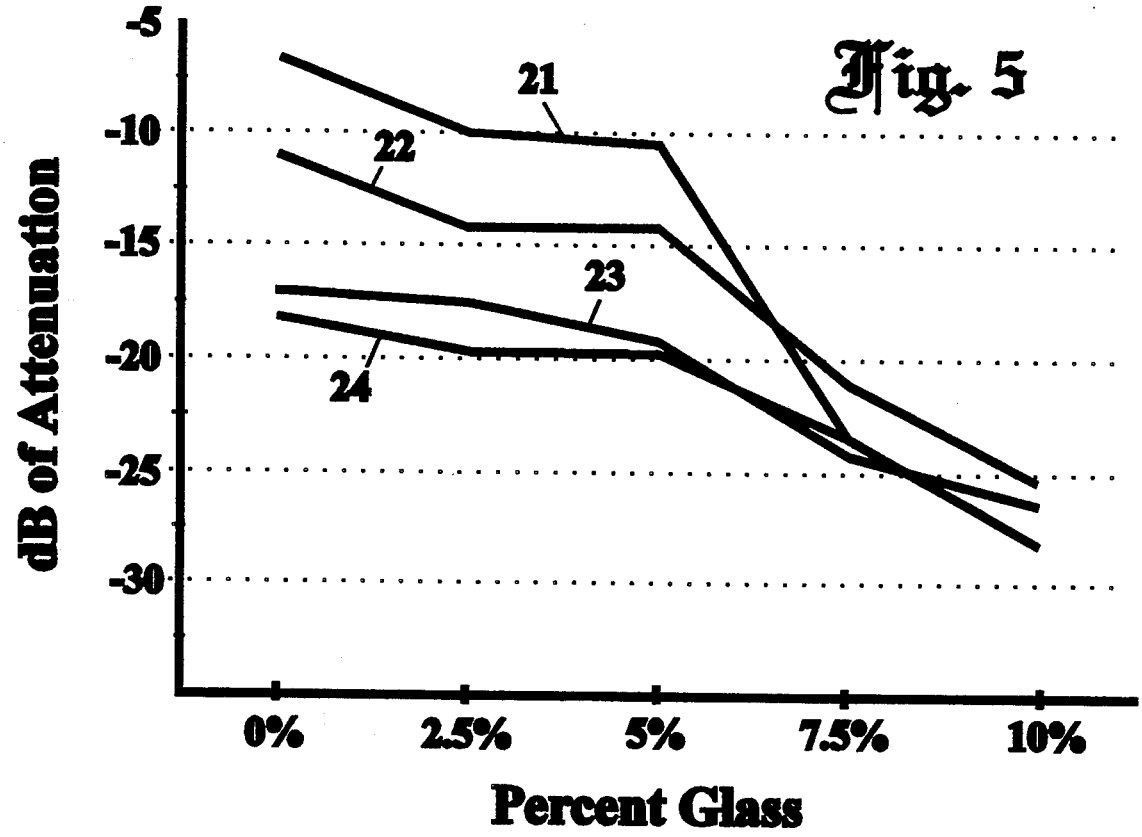
FIG. 5 is a graph showing the change in attenuation at several frequencies as the result of increasing proportions of low characteristic acoustic impedance particles embedded in an RTV (Room Temperature Vulcanizing) silicone substrate.

FIG. 5 shows attenuation as a function of concentration of glass micro spheres with diameters ranging from roughly 10 to roughly 100 microns embedded in Dow Corning ® Silastic ® T RTV for four frequencies. Glass micro spheres have a low characteristic acoustic impedance relative to Silastic ® T RTV. All samples were cast in the same mold to the same physical size, and subjected to a high vacuum during casting to ensure gas removal. Line 21 shows attenuation at 253.3 Hz, line 22 shows attenuation at 125.1 Hz, line 23 shows attenuation at 33.6 Hz, and line 24 shows attenuation at 61.0 Hz. Embedding more than 10% by weight of glass micro spheres in Silastic ® T is physically difficult so no data were collected beyond a 10% concentration. Inspection of FIG. 5 shows that attenuation has begun to negatively accelerate for most frequencies tested at a glass micro sphere concentration of 7.5%. A glass micro sphere concentration of 7.5% by weight in Silastic ® T maintains good physical characteristics and leaves space within the matrix material for particles of other types.

Figure 6:
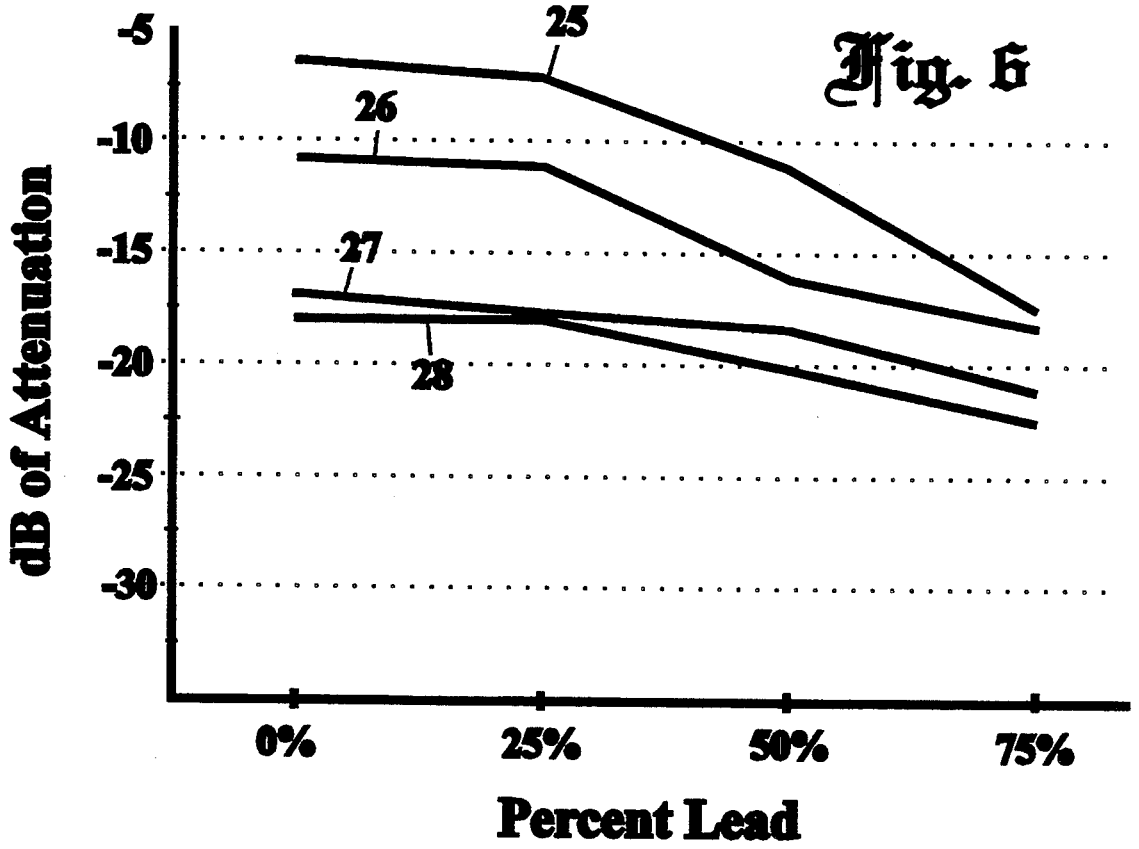
FIG. 6 is a graph showing the change in attenuation at several frequencies as the result of increasing proportions of embedded high characteristic acoustic impedance particles in an RTV silicone substrate.

FIG. 6 shows attenuation as a function of concentration of lead particles with diameters ranging from roughly 5 to roughly 100 microns embedded in Dow Corning ® Silastic ® T RTV for four frequencies. Lead particles have a high characteristic acoustic impedance relative to Silastic ® T RTV. All samples were cast in the same mold to the same physical size and subjected to a high vacuum during casting to ensure gas removal. Line 25 shows attenuation at 253.3 Hz, line 26 shows attenuation at 125.1 Hz, line 27 shows attenuation at 33.6 Hz, and line 28 shows attenuation at 61.0 Hz. Embedding more than 75% by weight of lead particles in Silastic ® T is physically difficult so no data were collected beyond a 75% concentration. Inspection of FIG. 6 shows that attenuation has begun to negatively accelerate for some frequencies tested at a lead particle concentration of 50%. A lead particle concentration of 50% by weight in Silastic ® T maintains good physical characteristics and leaves space within the matrix material for particles of other types.

Figure 7:
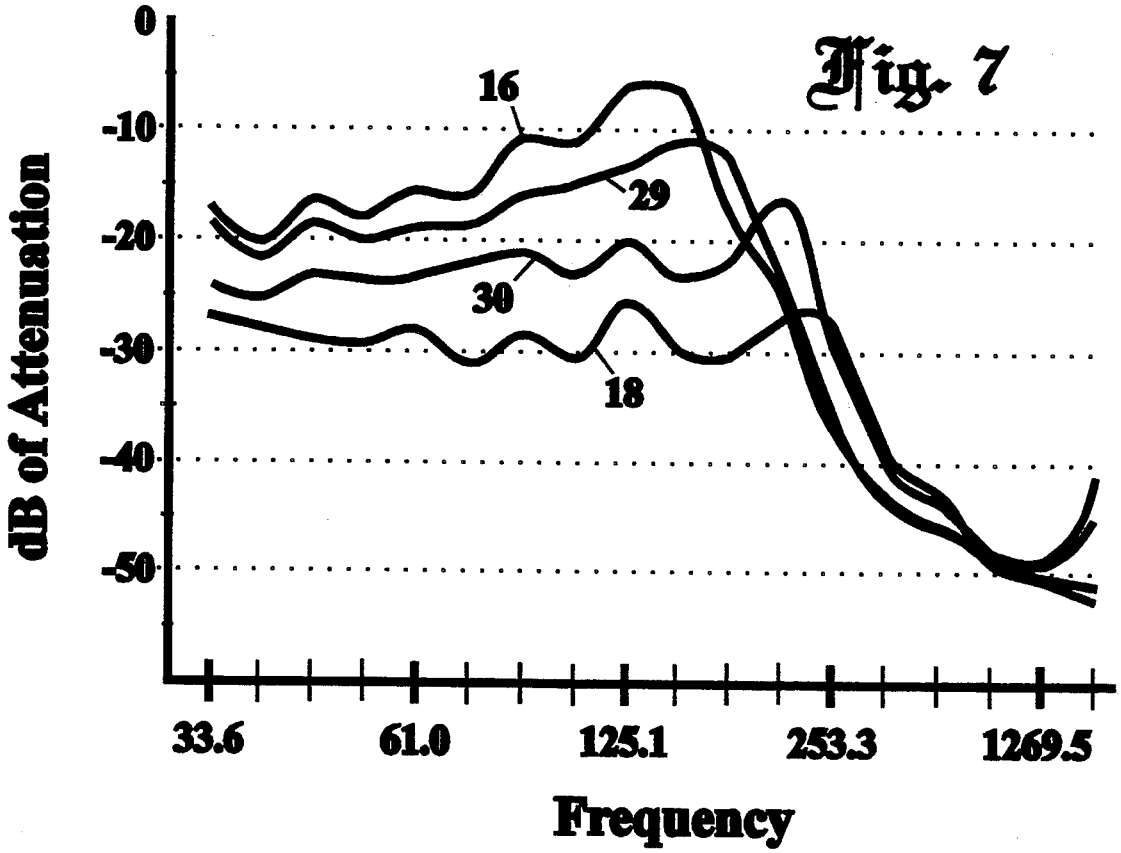
FIG. 7 is a graph showing the improvement in attenuation resulting from the teachings of the instant invention of an exemplary embodiment of the instant invention with an RTV silicone base.

FIG. 7 shows attenuation as a function of frequency for Dow Corning ® Silastic ® T RTV, 16; Dow Corning ® Silastic ® T RTV with 7.5% by weight embedded glass micro spheres with diameters ranging from roughly 10 to roughly 100 microns, 29; Dow Corning ® Silastic ® T RTV with 50% by weight embedded lead particles with diameters ranging from roughly 5 to roughly 100 microns, 30; and Dow Corning ® Silastic ® T RTV with 4.0% by weight embedded glass micro spheres with diameters ranging from roughly 10 to roughly 100 microns, and 48.0% by weight embedded lead particles with diameters ranging from roughly 5 to roughly 100 microns, 18. The proportions of 4% glass micro spheres, 48% lead particles, and 48% Silastic T matrix material are equivalent to the proportions of 7.5% glass micro spheres to matrix material and 50% lead particles to matrix material.

If the attenuation effect of high and low characteristic impedance particles simultaneously embedded in a matrix material were merely additive, then the attenuation curves 29 and 30 shown in FIG. 7 should add to curve 18, but clearly they do not. Curve 18 shows much more attenuation than the mere sum of curves 29 and 30, at least at the lower frequencies where improved attenuation is most desirable.

Urethane

Figure 8:
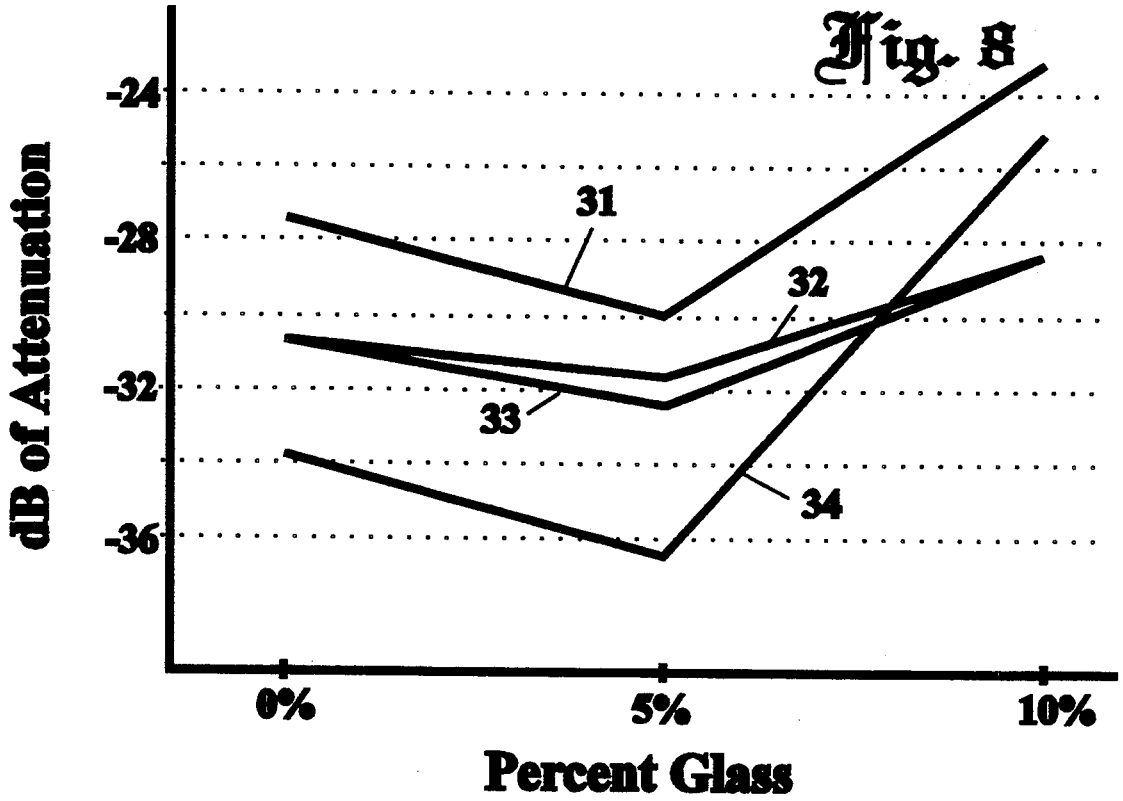
FIG. 8 is a graph showing the change in attenuation at several frequencies as the result of increasing proportions of low characteristic acoustic impedance particles embedded in a urethane substrate.

FIG. 8 shows attenuation as a function of concentration of glass micro spheres with diameters ranging from roughly 10 to roughly 100 microns embedded in Devcon ® Flexane ® 94 Liquid for four frequencies. Glass micro spheres have a low characteristic acoustic impedance relative to Flexane ® 94 Liquid. All samples were cast in the same mold to the same physical size and subjected to a high vacuum during casting to ensure gas removal. Line 31 shows attenuation at 33.6 Hz, line 32 shows attenuation at 61.0 Hz, line 33 shows attenuation at 125.1 Hz, and line 34 shows attenuation at 253.3 Hz. Embedding more than 10% by weight of glass micro spheres in Flexane ® 94 Liquid is physically difficult so no data were collected beyond a 10% concentration. Inspection of FIG. 8 shows that attenuation has reached a maximum for all frequencies tested at a glass micro sphere concentration of 5%. A glass micro sphere concentration of 5% by weight in Flexane ® 94 Liquid maintains good physical characteristics and leaves space within the matrix material for particles of other types.

Figure 9:
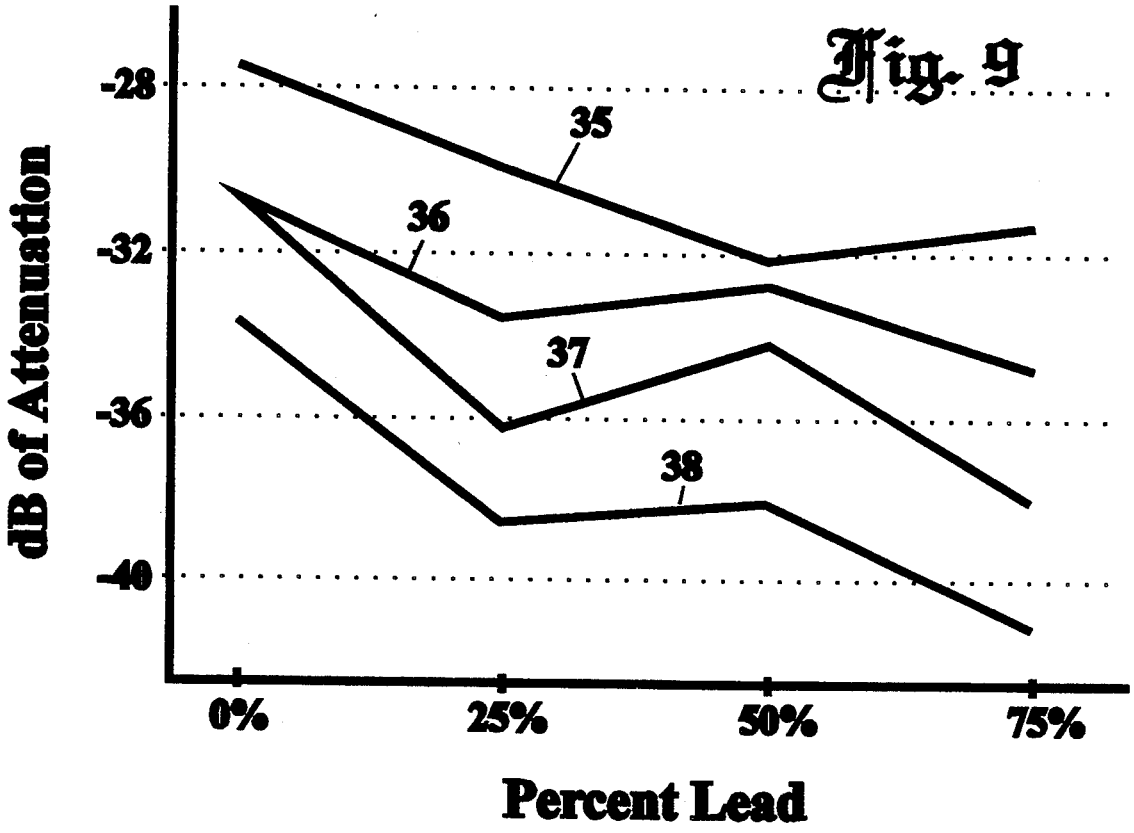
FIG. 9 is a graph showing the change in attenuation at several frequencies as the result of increasing proportions of high characteristic acoustic impedance particles embedded in a urethane substrate.

FIG. 9 shows attenuation as a function of concentration of lead particles with diameters ranging from roughly 5 to roughly 100 microns embedded in Devcon ® Flexane ® 94 Liquid for four frequencies. Lead particles have a high characteristic acoustic impedance relative to Flexane ® 94 Liquid. All samples were cast in the same mold to the same physical size, and subjected to a high vacuum during casting to ensure gas removal. Line 35 shows attenuation at 33.6 Hz, line 36 shows attenuation at 61.0 Hz, line 37 shows attenuation at 125.1 Hz, and line 38 shows attenuation at 253.3 Hz. Embedding more than 75% by weight of lead particles in Flexane ® 94 Liquid is physically difficult so no data were collected beyond a 75% concentration. Inspection of FIG. 9 shows that attenuation has begun to negatively accelerate for all frequencies tested at a lead particle concentration between 25% and 50%. A lead particle concentration of 35% by weight in Flexane ® 94 Liquid was interpolated. This concentration maintains good physical characteristics and leaves space within the matrix material for particles of other types.

Figure 10:
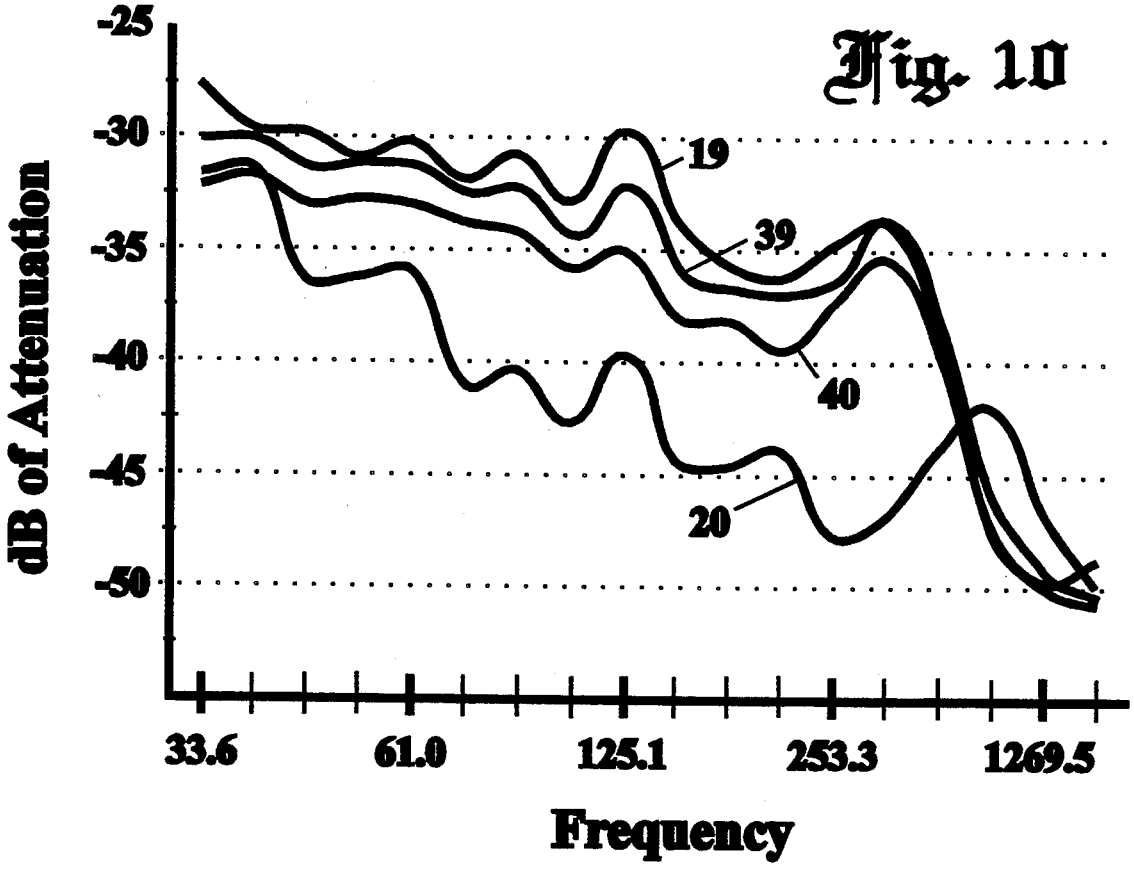
FIG. 10 is a graph showing the improvement in attenuation resulting from the teachings of the instant invention of an exemplary embodiment of the instant invention with a urethane base.

FIG. 10 shows attenuation as a function of frequency for Devcon ® Flexane ® 94 Liquid, 19; Flexane ® 94 Liquid with 5% by weight embedded glass micro spheres with diameters ranging from roughly 10 to roughly 100 microns, 39; Flexane ® 94 Liquid with 50% by weight embedded lead particles with diameters ranging from roughly 5 to roughly 100 microns, 40; and Flexane ® 94 Liquid with 3.3% by weight embedded glass micro spheres with diameters ranging from roughly 10 to roughly 100 microns, and 33.8% by weight embedded lead particles with diameters ranging from roughly 5 to roughly 100 microns, 20. The proportions of 3.3% glass micro spheres, 33.8% lead particles, and 62.9% Flexane ® 94 Liquid matrix material are equivalent to the proportions of 5% glass micro spheres to matrix material and 35% lead particles to matrix material.

If the attenuation effect of high and low characteristic impedance particles simultaneously embedded in a matrix material were merely additive, then the attenuation curves 39 and 40 shown in FIG. 10 should add to curve 20, but clearly they do not. Curve 20 shows much more attenuation than the mere sum of curves 39 and 40 at many of the tested frequencies.

Many different materials can be made more vibration and acoustic energy attenuating using the teachings of the instant invention. Application of these materials covers a very wide range of possibilities including the opportunity to optimize a particular material for sound attenuation while maintaining good structural and weight characteristics. Ear protection cups may be improved. Interior panels in automobiles and airplanes can be made more sound attenuating. Building materials from roof coatings to room isolation and structural panels are also possibilities. Heavy machinery can be more effectively isolated from surrounding structures. Submarines, which depend on stealth for survival, can be made much more silent.

Many modifications and variations of the present invention are possible in light of the above teachings. Thousands of materials are available from which to make high and low characteristic acoustic impedance particles, and thousands of materials can serve as matrix materials in the instant invention, including most polymers, elastomers and solid petroleum extracts as well as such conventional building materials as gypsum board and composition blocks and panels. It is therefore to be understood that, within the scope of the appended claims, the instant invention may be practiced otherwise than as specifically described.

We claim:

1. An acoustic attenuation and vibration damping material comprised of a matrix material with a plurality of at least two species of particles incorporated therein, said particles being species differentiated by their characteristic acoustic impedances, and said particle species being proportionally distributed in said matrix material so that an increase in acoustic attenuating and vibration damping effect of said matrix material with said combination of at least two species of particles incorporated therein, relative to the acoustic attenuating and vibration damping effect of said matrix material with no particles incorporated therein, is greater than the sum of increases in acoustic attenuating and vibration damping effects of each particle species incorporated individually at the same concentration in said matrix material, relative to the acoustic attenuating and vibration damping effect of said matrix material with no particles incorporated therein.

2. The acoustic attenuation and vibration damping material of claim 1 where said matrix material is a urethane type material.

3. The acoustic attenuation and vibration damping material of claim 1 where said matrix material is a silicone rubber type material.

4. The acoustic attenuation and vibration damping material of claim 1 where said matrix material is an elastomer.

5. The acoustic attenuation and vibration damping material of claim 1 where said matrix material is a polymer.

6. The acoustic attenuation and vibration damping material of claim 1 where said matrix material is a petroleum extract.

7. The acoustic attenuation and vibration damping material of claim 1 where said matrix material is gypsum.

8. The acoustic attenuation and vibration damping material of claim 1 where one of said particle species is lead.

9. The acoustic attenuation and vibration damping material of claim 1 where one of said particle species is steel.

10. The acoustic attenuation and vibration damping material of claim 1 where one of said particle species is glass micro spheres.

11. The acoustic attenuation and vibration damping material of claim 1 where one of said particle species is cork.

* * * * *